US007610787B2

(12) United States Patent
Itaya

(10) Patent No.: US 7,610,787 B2
(45) Date of Patent: Nov. 3, 2009

(54) SPRING MANUFACTURING APPARATUS AND CONTROL METHOD THEREOF

(75) Inventor: Ichiro Itaya, Katsushika-ku (JP)

(73) Assignee: Kabushiki Kaisha Itaya Seisaku Sho, Tokyo (JP)

( * ) Notice: Subject to any disclaimer, the term of this patent is extended or adjusted under 35 U.S.C. 154(b) by 0 days.

(21) Appl. No.: 11/881,452

(22) Filed: Jul. 26, 2007

(65) Prior Publication Data

US 2008/0022742 A1 Jan. 31, 2008

(30) Foreign Application Priority Data

Jul. 26, 2006 (JP) ..... 2006-203670

(51) Int. Cl.
*B21F 3/02* (2006.01)
*B21D 43/00* (2006.01)
*B21F 35/00* (2006.01)

(52) U.S. Cl. ..... 72/137; 72/135; 72/142; 72/420

(58) Field of Classification Search ..... 72/135, 72/137, 140, 141, 142, 420, 421, 422, 311, 72/138
See application file for complete search history.

(56) References Cited

U.S. PATENT DOCUMENTS 5,732,583 A * 3/1998 Itaya ..... 72/137
5,771,735 A * 6/1998 Caporusso et al. ..... 72/307
5,887,471 A 3/1999 Itaya
6,701,765 B2 3/2004 Itaya
2004/0065130 A1 4/2004 Itaya
2005/0204794 A1* 9/2005 Speck ..... 72/137

FOREIGN PATENT DOCUMENTS

DE 44 47 253 A1 1/1996
DE 102 15 047 C1 9/2003
JP 9-085375 3/1997
JP 2002-239666 8/2002
JP 2004-122195 4/2004

OTHER PUBLICATIONS

German Office Action dated Aug. 4, 2008.
Japanese Office Action dated Nov. 4, 2008.

* cited by examiner

*Primary Examiner*—Dana Ross
*Assistant Examiner*—Debra M Sullivan
(74) *Attorney, Agent, or Firm*—Merchant & Gould P.C.

(57) ABSTRACT

A spring manufacturing apparatus 100 comprises: a wire feeder 300; a wire guide 320 for guiding the wire; tool units 400B and 400D, a plurality of which can be slidable toward a spring forming space; a grip unit 500 having face-to-face fingers arranged to be adjacent to an end portion of the wire guide for gripping part of an yet-to-be-cut spring that has been formed primarily into a partially finished shape in the spring forming space; grip driving units 520 and 530 for executing reciprocal motion of the grip unit which is parallel to the wire axis line and rotational motion of the grip unit on the wire axis line; and an arm unit 540 extended forward from the forming table for holding the grip unit and grip driving unit through a holder 550 fixed to the end portion of the arm.

1 Claim, 12 Drawing Sheets

SPRING MANUFACTURING APPARATUS AND CONTROL METHOD THEREOF

CROSS-REFERENCE TO RELATED APPLICATION

This application is entitled to the benefit of Japanese Patent Application No. 2006-203670, filed Jul. 26, 2006.

BACKGROUND OF THE INVENTION

1. Field of the Invention

The present invention relates to a spring manufacturing technique where a continuously fed wire which is to become, for example, a spring, is forcibly bent, wound, or coiled by tools in a spring forming space.

2. Description of the Related Art

A conventionally available spring manufacturing apparatus can form various shapes of springs by numerical control (e.g., U.S. Pat. No. 5,887,471). In this conventional spring manufacturing apparatus, a plurality of tools are arranged in a radial pattern on intervals of 45° on a forming table with a wire as its center, which is fed out to a spring forming space on the forming table, and each of the tools is supported by a tool supporting mechanism and independently driven by servomotors.

Since the conventional spring manufacturing apparatus does not comprise means for gripping the wire, which has been fed from the wire guide, formed into a partially(or partway) finished shape and cut, for processing the cut wire, it is impossible to re-perform processing on the cut and partially finished wire with the same apparatus and form the wire into a final shape. Therefore, in order to form, without cutting the wire, a spring having a complicated shape, for example, a double-torsion spring (torsion coil spring) whose wire ends are both coiled or wound, the plurality of tools shown in FIGS. 11 and 12 need to be moved in a precise and complicated fashion. This leaves room for improvement in productivity. Furthermore, if tools for exclusive use or a large number of tools are necessary, the number of servomotors for driving the tools also increases. While the apparatus' processing capability may be enhanced, there is still scope to improve the aspect of cost.

SUMMARY OF THE INVENTION

The present invention has been proposed in view of the above-described problems, and has as its object to achieve a spring manufacturing technique that can easily form a spring of a complicated shape with a smaller number of tools than the conventional technique.

In order to solve the above-described problems and achieve the object, a spring manufacturing apparatus 100 according to the present invention comprises: a wire feeder 300 for feeding a wire; a wire guide 320 for guiding the wire fed out of the wire feeder to a spring forming space on a forming table 200; tool units 400A to 400D, a plurality of which can be detachably mounted onto the forming table in a radial pattern with the spring forming space as the center (arranged radially arround the spring forming space), for supporting tools TA, TC and TD so that the tools can be thrust in and out (slidable) toward the spring forming space; grip units 500 and 510 having face-to-face fingers 511*a* and 511*b* arranged to be adjacent to an end portion of the wire guide for gripping part of a yet-to-be-cut spring that has been formed primarily into a partially finished shape in the spring forming space; grip driving units 520 and 530 for executing reciprocal motion of the grip unit which is parallel to the wire axis line and rotational motion of the grip unit on the wire axis line; and an arm unit 540 extended forward from the forming table for holding the grip unit and grip driving unit through a holder 550 fixed to the end portion of the arm.

Furthermore, in the above-described configuration, the grip driving unit comprises a first servomotor 521 for having the grip unit perform reciprocal motion parallel to the wire axis line, and a second servomotor 531 for having the grip unit perform rotational motion on the wire axis line. Each of the first and second servomotors is attached to the holder.

Furthermore, in the above-described configuration, the arm unit 540 is configured with a plurality of vertically arranged rods, one of whose end portions 541 are fixed to the forming table with screw portions formed thereon, and the other end portions 542 extend forward like cantilevers from the forming table. The holder is configured with a plurality of board members 551 and 552 holding the first and second servomotors.

Furthermore, in the above-described configuration, the spring manufacturing apparatus further comprises a driving unit 510 for having the fingers grip or release the primarily formed spring using air.

Still further, the present invention provides a control method of a spring manufacturing apparatus having: a wire feeder 300 for feeding a wire; a wire guide 320 for guiding the wire fed out of the wire feeder to a spring forming space on a forming table; tool units 400A to 400D, a plurality of which can be detachably mounted onto the forming table in a radial pattern with the spring forming space as the center (arranged radially arround the spring forming space), for supporting tools TA, TC and TD so that the tools can be thrust in and out (slidable) toward the spring forming space; and grip units 500 and 510 having face-to-face fingers 511*a* and 511*b* arranged to be adjacent to an end portion of the wire guide for gripping part of a yet-to-be-cut spring that has been formed into a partially finished shape in the spring forming space. The method comprises: a primary forming step S1 of forming the wire fed out of an end portion of the wire guide into a partially finished shape using the tools; gripping steps S2 and S3 of gripping part of the primarily formed spring using the fingers of the grip unit; cutting steps S4 and S5 of cutting the wire which extends from the primarily formed spring to the wire guide, while the wire is gripped by the fingers; and secondary forming steps S6 to S12 of forming the primarily formed spring, which is gripped by the fingers after being cut, into a final shape using the tools.

According to the present invention, it is possible to easily form a spring of a complicated shape with a smaller number of tools than the conventional technique, and to achieve improved productivity and cost reduction.

Other objects and advantages besides those discussed above shall be apparent to those skilled in the art from the description of a preferred embodiment of the invention as follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DESCRIPTION OF THE EMBODIMENT

A preferred embodiment of the present invention will now be described in detail in accordance with the accompanying drawings.

Note that the following embodiment is merely examples to carry out the present invention. The present invention is applicable to corrected or modified forms of the following embodiment within the scope of the spirit of the present invention.

[Overall Configuration of Spring Manufacturing Apparatus (FIGS. 1 to 4)]

Figure 1:
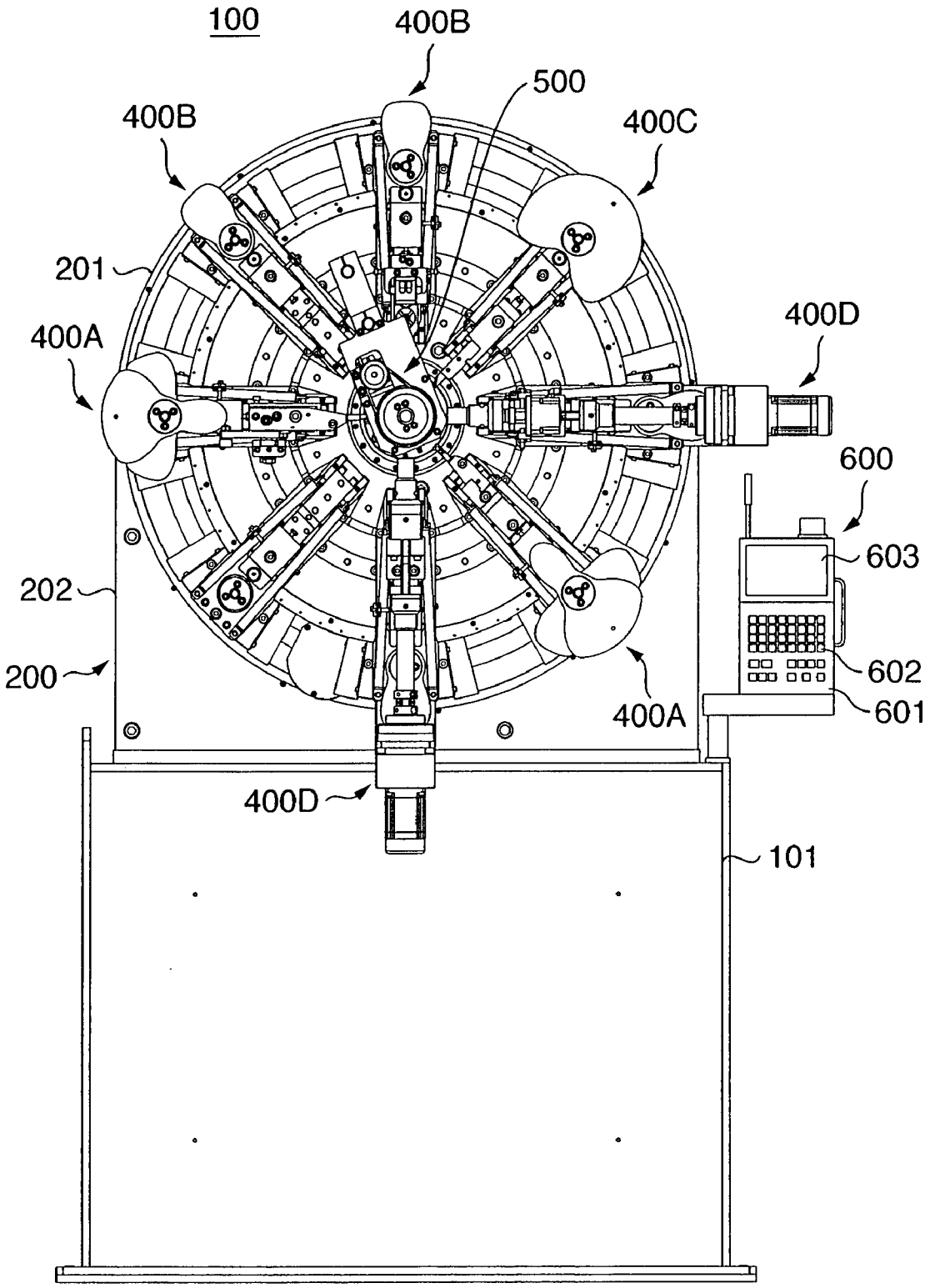
FIG. 1 is a front view of a spring manufacturing apparatus according to an embodiment of the present invention.
Figure 2:
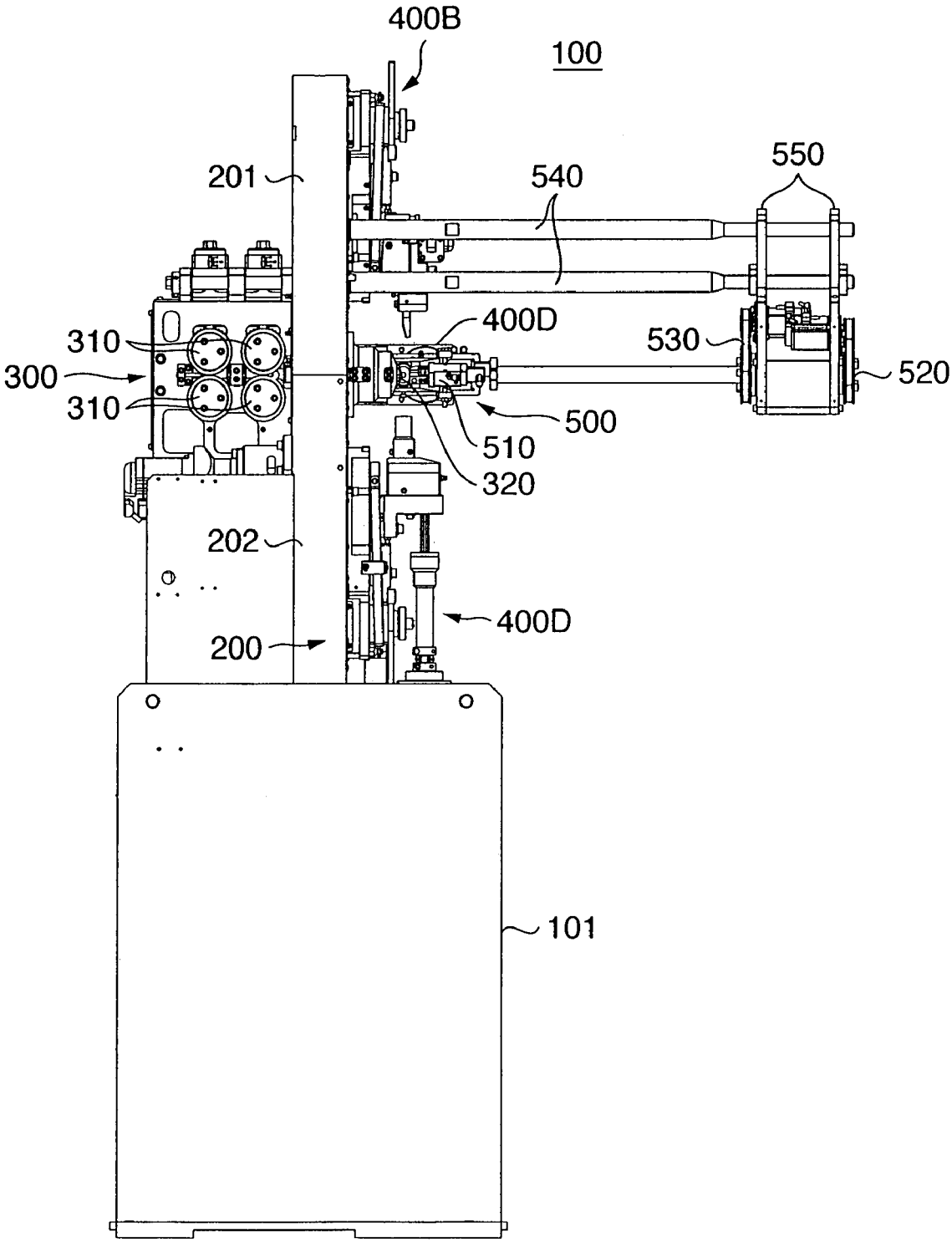
FIG. 2 is a left side view of the spring manufacturing apparatus according to the embodiment of the present invention.
Figure 3:
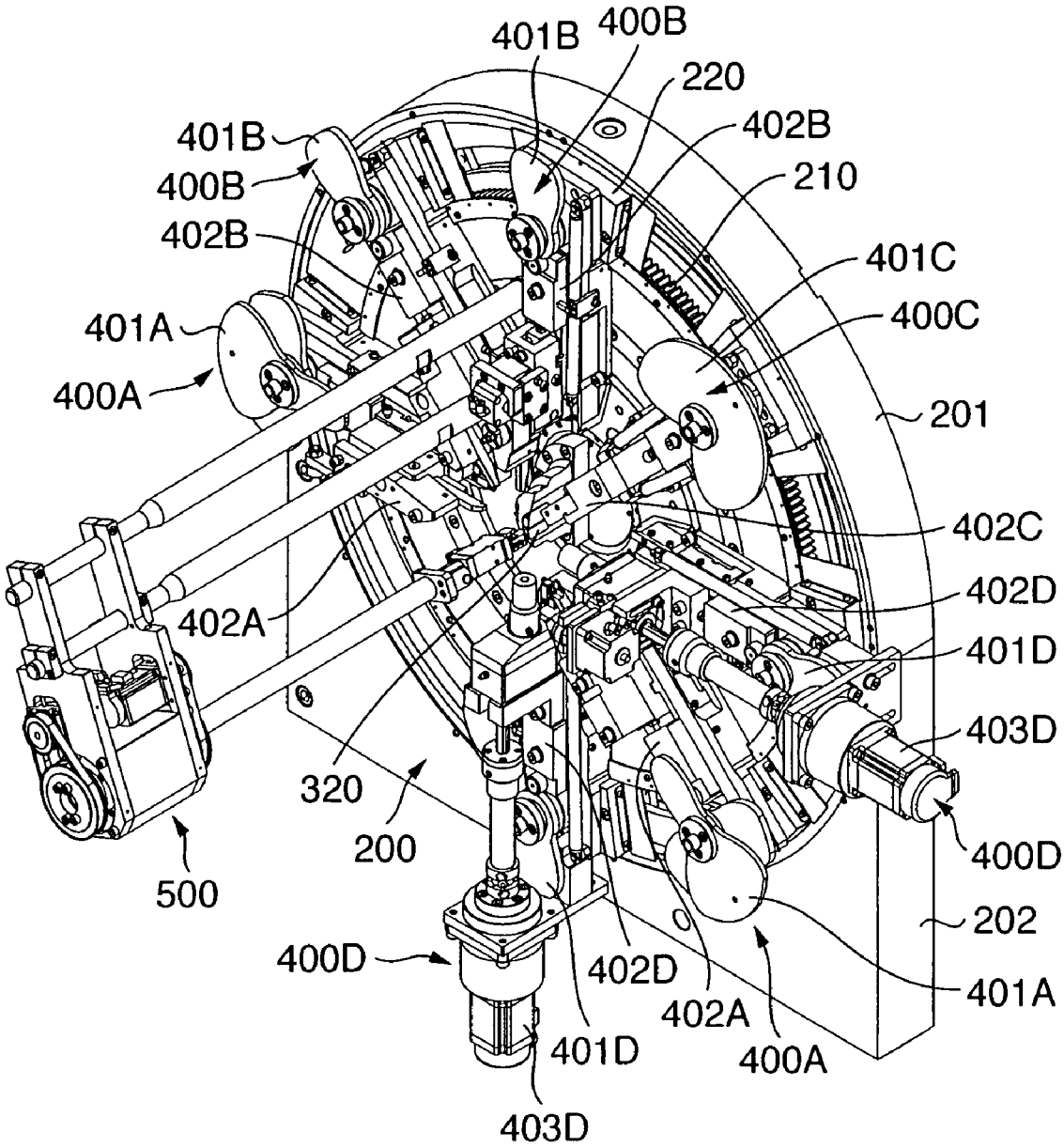
FIG. 3 is a perspective view of a spring forming table according to the embodiment of the present invention.
Figure 4:
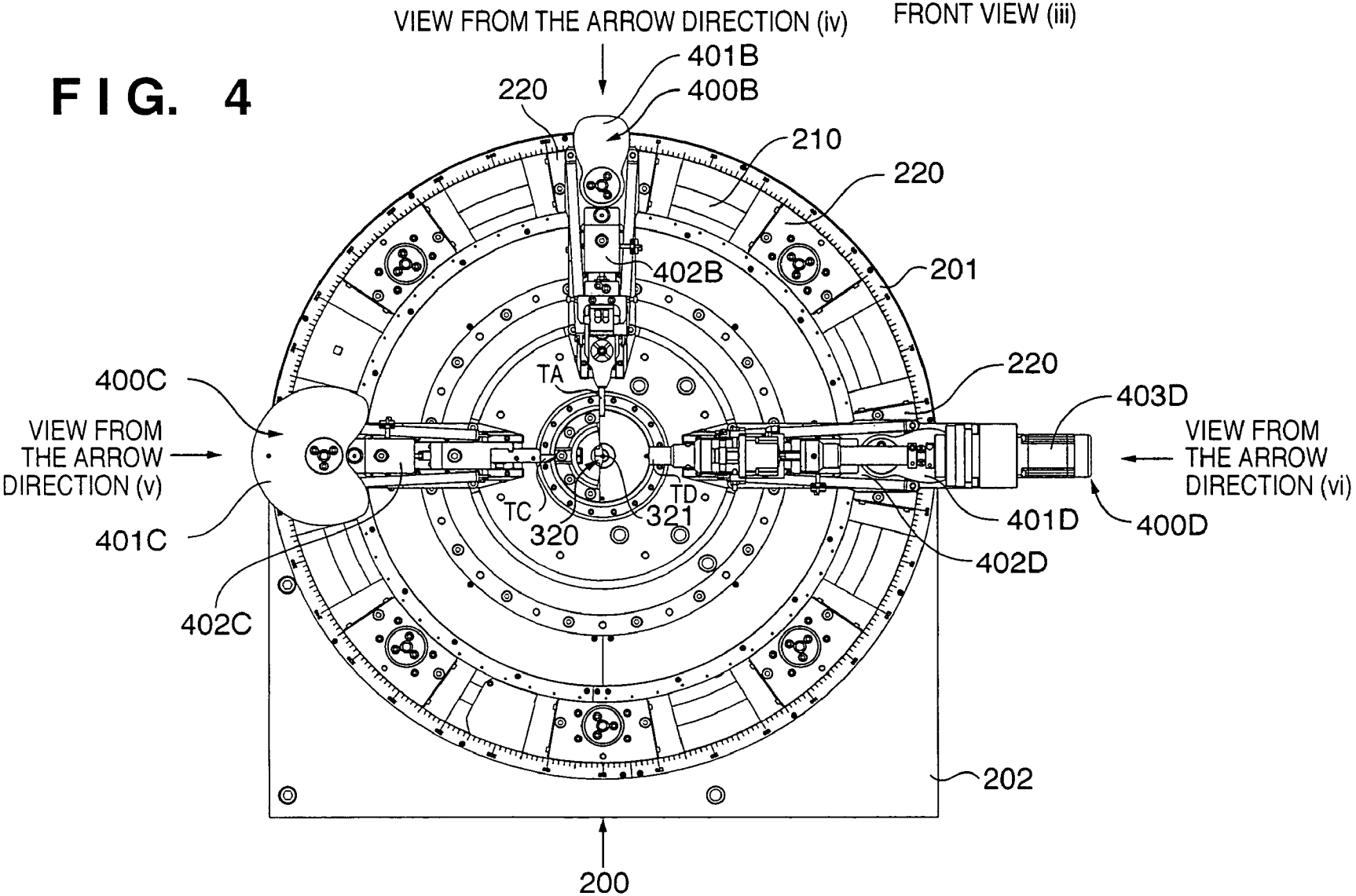
FIG. 4 is a front view of the spring forming table according to the embodiment of the present invention, from which a secondary forming grip unit is excluded.

FIG. 1 is a front view of a spring manufacturing apparatus according to the embodiment of the present invention. FIG. 2 is a left side view of the spring manufacturing apparatus according to the embodiment. FIG. 3 is a perspective view of a spring forming table according to the embodiment. FIG. 4 is a front view of the spring forming table according to the embodiment, from which a secondary forming grip unit is excluded.

As shown in FIGS. 1 to 4, the spring manufacturing apparatus 100 according to the present embodiment comprises: a forming table 200 mounted vertically on top of a box-shaped base 101; a wire feeder 300 arranged on the back surface of the forming table 200; a plurality of tool units 400A, 400B, 400C, and 400D arranged on the front surface of the forming table 200 in a radial pattern with the wire axis line as the center; a secondary forming grip unit 500 for gripping part of a spring that has been formed into a partially finished shape; and a control unit 600 arranged on the forming table 200 laterally to the base 101.

The forming table 200 comprises a circular unit 201 and an extension unit 202 that is extended downward from the bottom half of the circular unit, and the extension unit 202 is mounted to the base 101. On the central portion of the circular unit 201, a wire guide 320 is arranged. With a wire feeding hole (wire axis line) of the wire guide 320 as the center, the plurality of tool units 400A to 400D are arranged in a radial pattern, thereby defining the spring forming space.

The wire feeder 300 comprises plural pairs of feed rollers 310 that are face to face with each other for feeding the wire which will become a spring from a supply source (not shown). The wire pushed out of the pairs of feed rollers 310 is fed by the wire guide 320 to the spring forming space.

While one pair of feed rollers 310 that are face to face with each other tightly grip the wire, each roller is rotated in the wire feeding direction, thereby feeding out the wire from the end portion of the wire feeding hole 321 provided on the wire guide 320.

The wire guide 320 is rotatably controlled by a servomotor (not shown) in both the positive and negative directions with the wire feeding hole 321 (wire axis line) as the center. Further, rotation of the pairs of feed rollers 310 in the wire feeding direction is controlled by a servomotor (not shown).

The tool units 400A, 400B, 400C, and 400D comprise: the slide tool units 400A and 400B movably supporting various processing tools that can be thrust in and out in slide motions toward the spring forming space near the wire feeding hole 321 of the wire guide 320; the cutting tool unit 400C movably supporting a cutting tool that can be thrust in and out in slide motions toward the spring forming space; and the rotational tool unit 400D that can rotate the tools on the tool axis in addition to the aforementioned slide motions.

Each of these tool units is detachably provided to the circular unit 201 of the forming table 200. It is possible to attach up to 8 tool units in total to the forming table 200.

Slidably attached to the slide tool units 400A and 400B are tools for forcibly bending, winding, and coiling the wire fed from the wire feeding hole 321 of the wire guide 320 to the spring forming space.

Slidably attached to the cutting tool unit 400C is a tool for cutting, with shear force in cooperation with the wire guide 320, the wire fed from the wire feeding hole 321 of the wire guide 320 to the spring forming space.

Slidably and rotatably attached to the rotational tool unit 400D is a tool for forcibly winding the wire fed from the wire feeding hole 321 of the wire guide 320 to the spring forming space.

The slide motions of the respective tools mounted to the tool units 400A to 400D are implemented by: a single ring gear 210 arranged on the forming table 200 which serves as a common driving source for all tool units; camshaft blocks 220 which transmit rotational force from the ring gear 210 to each of the tool units 400A to 400D; cams 401A to 401D mounted to the respective tool units and driven by the camshaft blocks 220; and sliders 402A to 402D which hold the tools. Further, the rotational motion of the rotational tool unit 400D is implemented by the servomotor 403D provided in each tool unit.

Note that, since detailed descriptions of the ring gear 210 and camshaft block 220 are disclosed in Japanese Patent Application Laid-Open (KOKAI) No. 2004-122195, descriptions thereof are omitted herein.

The control unit 600 comprises: a controller 601 for controlling operation of the entire apparatus; a console 602 including a keyboard and various switches for inputting parameters to the controller 601 and giving the instruction for operation start or stop; and a display 603 consisting of an LCD or the like for displaying the operation status of the apparatus.

[Secondary Forming Grip Unit (FIGS. 5A-5D to 7A-7B)]

Figure 6A:
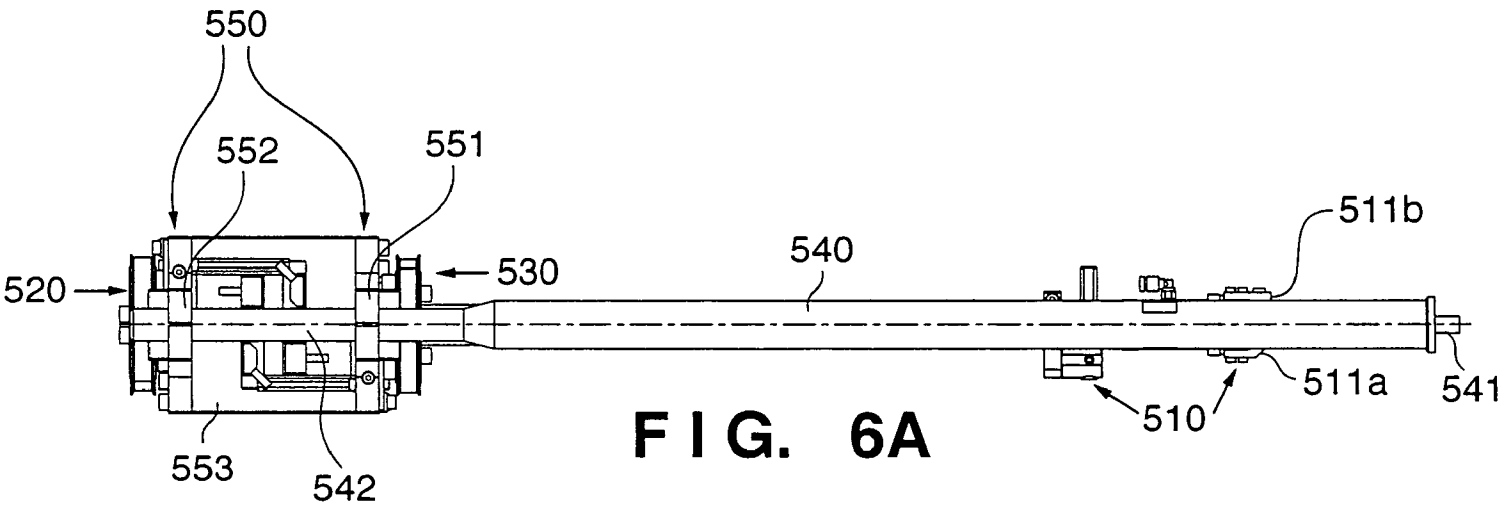
FIGS. 6A to 6C are respectively a plan view, left side view, and right side view of FIG. 5A.
Figure 6C:
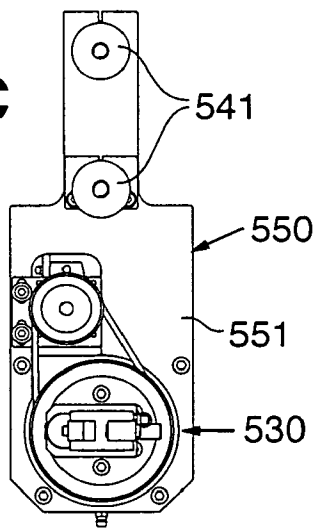
Figure 6B:
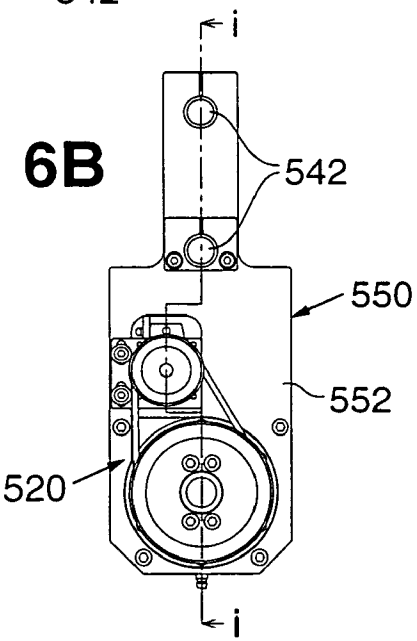
Figure 7A:
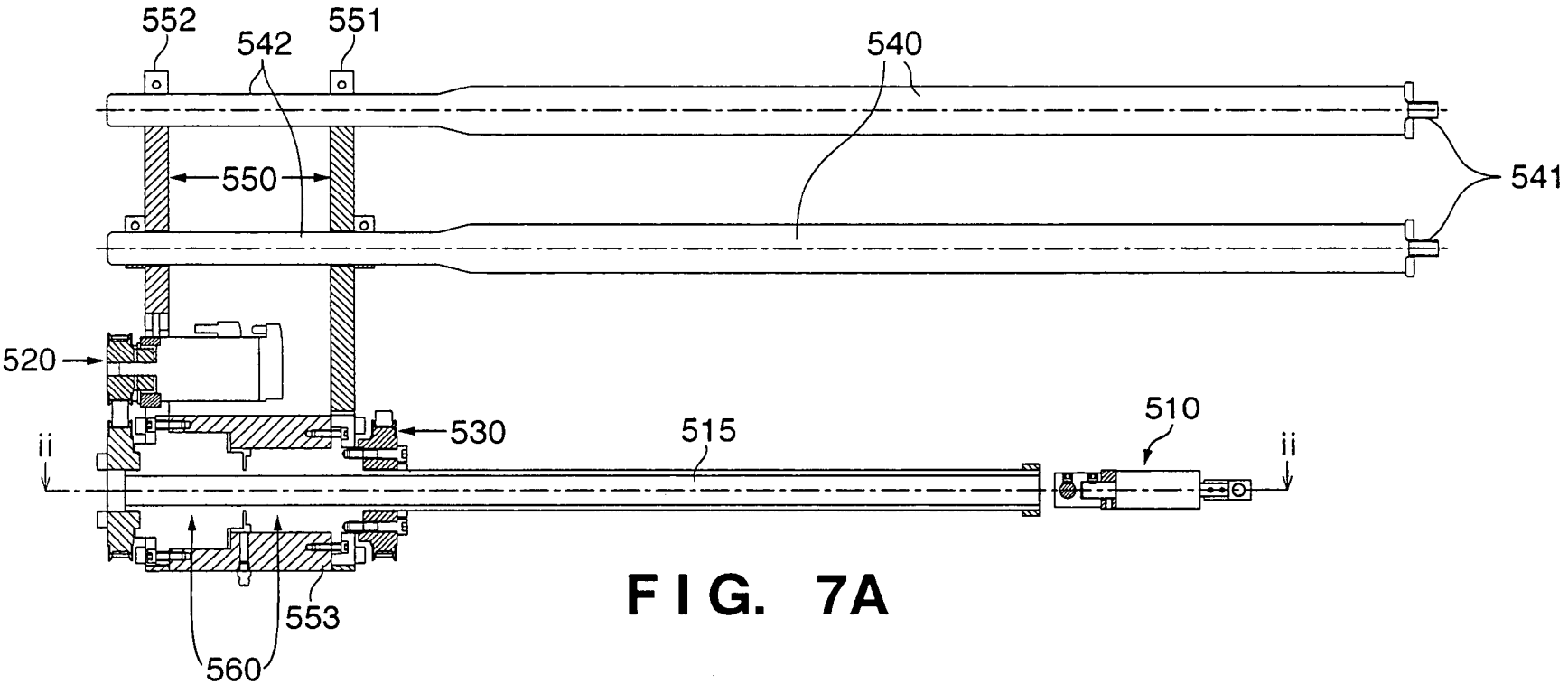
FIG. 7A is a i-i cross-section of FIG. 6B.
Figure 7B:
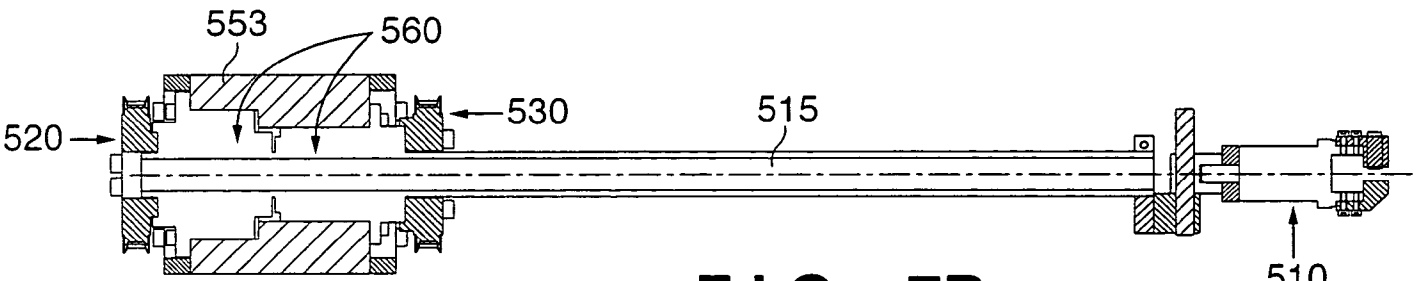
FIG. 7B is a ii-ii cross-section of FIG. 7A.

FIGS. 5A to 5D are respectively perspective views of a secondary forming grip unit, air chuck, back-and-forth servo unit, and rotational servo unit, which are mounted to the spring manufacturing apparatus according to the embodiment. FIGS. 6A to 6C are respectively a plan view, left side view, and right side view of FIG. 5A. FIG. 7A is a i-i cross-section of FIG. 6B, and FIG. 7B is a ii-ii cross-section of FIG. 7A.

As shown in FIGS. 2, 5A to 5D, 6A to 6C, and 7A to 7B, the secondary forming grip unit 500 comprises: an air chuck 510 having a pair of face-to-face fingers 511*a* and 511*b*, arranged to be adjacent to the end portion of the wire guide 320 for gripping part of the yet-to-be-cut spring that has been formed primarily into a partially finished shape in the spring forming space; a back-and-forth servo unit 520 for having the air chuck 510 perform reciprocal motion parallel to the wire axis line; a rotational servo unit 530 for having the air chuck 510 perform rotational motion on the wire axis line; and an arm 540 extended forward from the forming table for holding the air chuck 510, back-and-forth servo unit 520, and rotational servo unit 530 through a holder 550 fixed to the end portion of the arm.

Figure 5A:
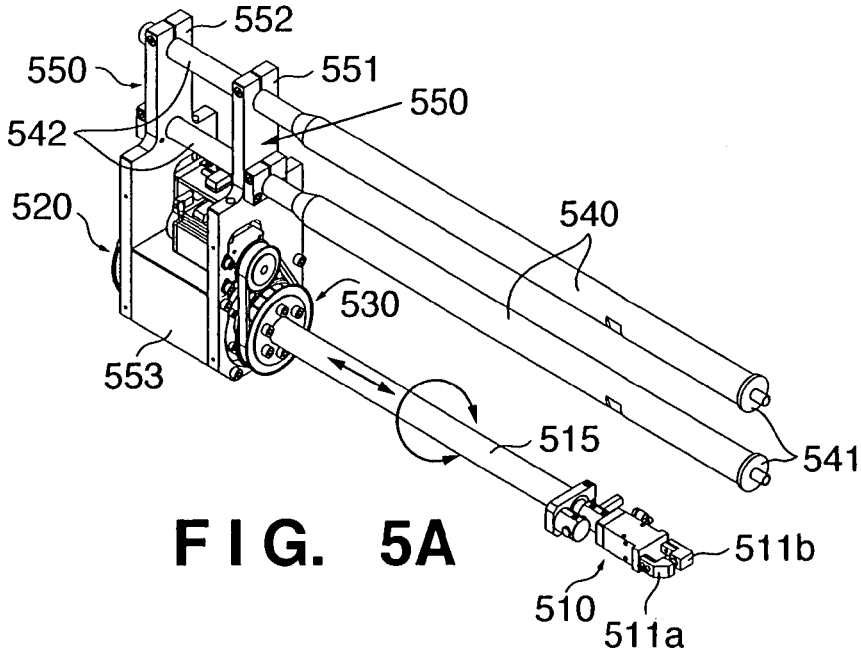
FIGS. 5A to 5D are respectively perspective views of a secondary forming grip unit, air chuck, back-and-forth servo unit, and rotational servo unit, which are mounted to the spring manufacturing apparatus according to the embodiment.
Figure 5B:
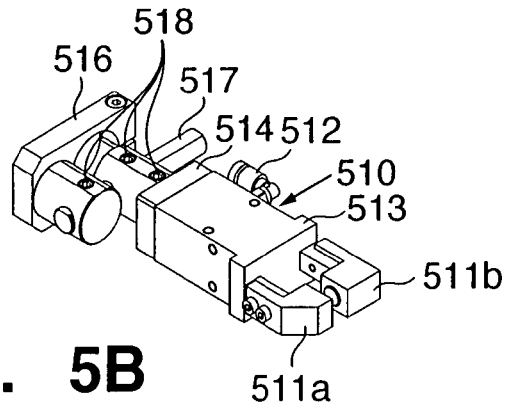

The air chuck 510 shown in FIG. 5B comprises: a chuck main body 513 having the fingers 511*a* and 511*b* as well as a connector 512 connected to a compressor (not shown); and a joint 514 that fixes the chuck main body 513 to a movable rod 515 by being fastened with screws or the like. The chuck main body 513 grips or releases the primarily formed spring by bringing together or separating the fingers 511*a* and 511*b* using air pressure introduced from the compressor (not shown) through the connector 512. The joint 514 is fixed to one end of the movable rod 515 through a bracket 516. A through-hole is formed in the joint 514 and bracket 516. A mutual pole member 517 is inserted into the through-hole of the joint 514 and bracket 516, and the joint 514 and bracket 516 are fixed with screws or the like after their positions and postures are appropriately adjusted.

Figure 5C:
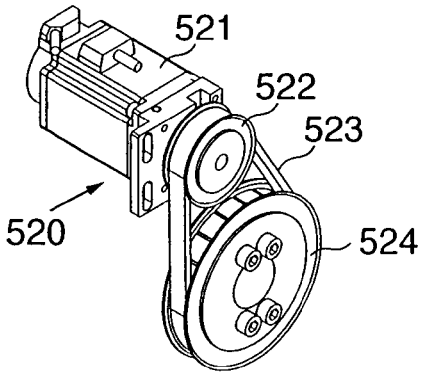

The back-and-forth servo unit 520 shown in FIG. 5C comprises: a servomotor 521; a driving pulley 522 fixed to the driving axis of the servomotor 521; and a driven pulley 524 that is driven by rotational force (torque) of the driving pulley 522 transmitted through a timing belt 523.

Figure 5D:
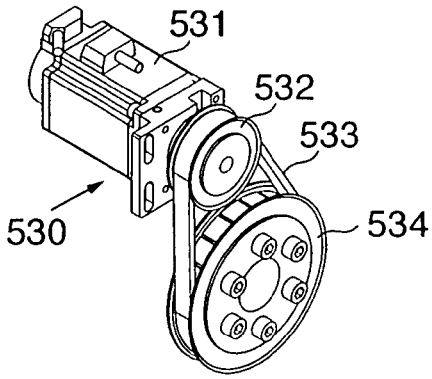

The rotational servo unit 530 shown in FIG. 5D comprises: a servomotor 531; a driving pulley 532 fixed to the driving axis of the servomotor 531; and a driven pulley 534 that is driven by rotational force (torque) of the driving pulley 532 transmitted through a timing belt 533.

The back-and-forth servo unit 520 and rotational servo unit 530 are held by the holder 550 consisting of two face-to-face board members 551 and 552 and a case 553.

The case 553 incorporates a ball screw spline bearing 560 that can simultaneously carry out reciprocal motion of the movable rod 515 parallel to the wire axis line which is driven by the back-and-forth servo unit 520 and rotational motion of the movable rod 515 on the wire axis line which is driven by the rotational servo unit 530.

The arm 540 is configured with plural (two) vertically arranged rods, one of whose end 541 is fixed to the forming table 200, and the other end 542 extends forward like cantilevers from the forming table 200. The other end portions 542 of the arm 540 are fixed to two holders 550 with screws or the like.

By the control unit 600 controlling respective operations of the air chuck 510 (compressor), back-and-forth servo unit 520, and rotational servo unit 530, gripping and releasing operation of the primarily formed spring, back-and-forth and rotational motions of the air chuck 510 which will be described later are carried out.

[Configuration of Control Unit (FIG. 8)]

Figure 8:
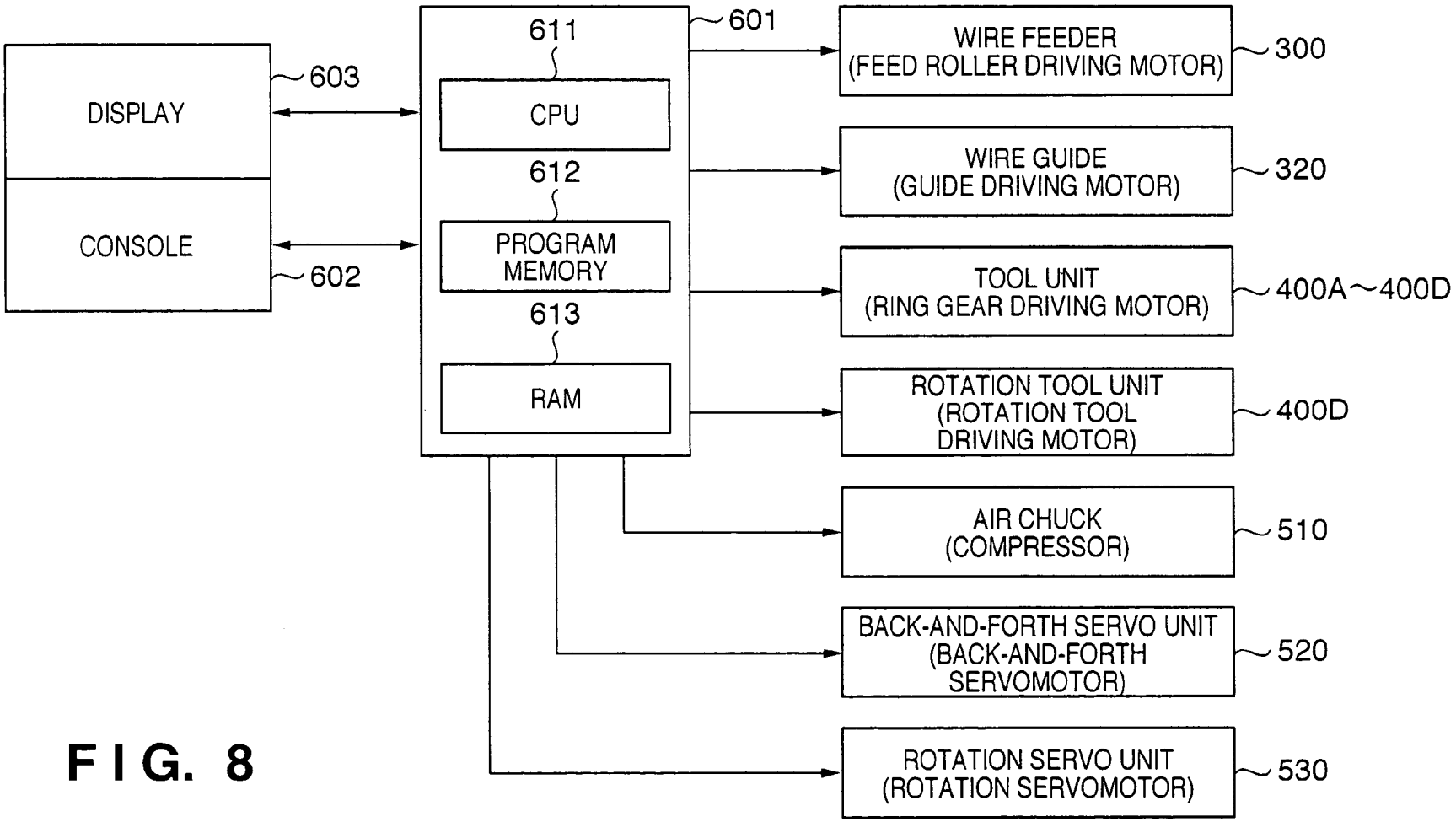
FIG. 8 is a block diagram showing a configuration of a control unit of the spring manufacturing apparatus according to the embodiment.

FIG. 8 is a block diagram showing a configuration of a control unit of the spring manufacturing apparatus according to the embodiment.

In FIG. 8, the controller 601 comprises: a CPU 611 for controlling the overall apparatus; program memory (ROM) 612 for storing a spring manufacturing processing program of the CPU 611; and RAM 613 used as a work area of the CPU 611 and used for storing a control program downloaded from the ROM 612 or position data and the like.

The controller 601 controls, at a predetermined timing, a feed roller driving motor of the wire feeder 300, a guide driving motor for driving the wire guide 320, a ring gear driving motor for realizing slide motion of respective tool units 400A to 400D, a rotation tool driving motor for realizing rotational motion of the rotational tool unit 400D, the compressor for driving the air chuck 510, the back-and-forth servomotor for driving the air chuck 510 in the back-and-forth directions, and the rotational servomotor for rotationally driving the air chuck 510, respectively in accordance with the aforementioned spring manufacturing processing program.

[Spring Manufacturing Method (FIGS. 4, 9 and 10)]

Figure 9:
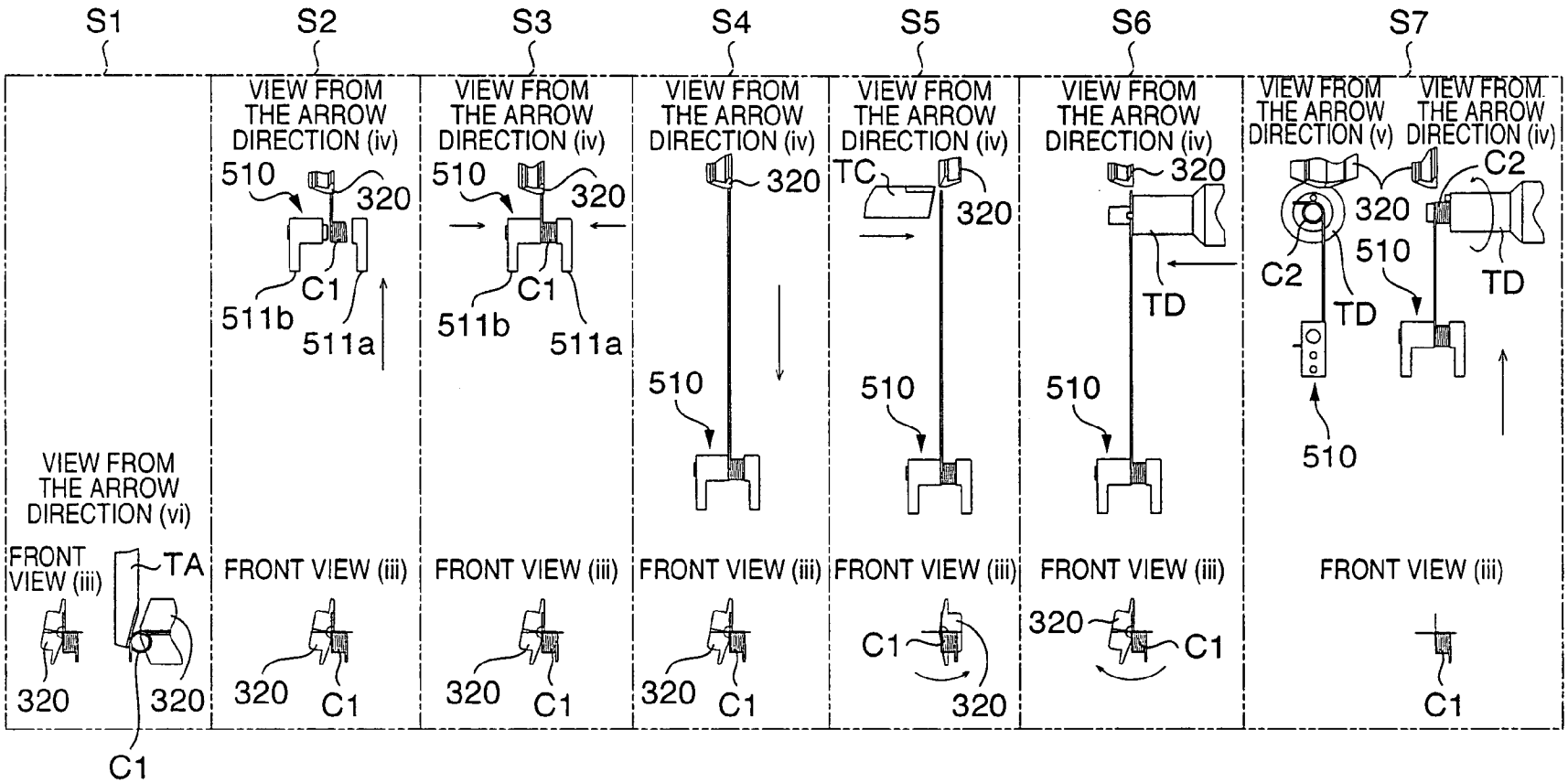
FIG. 9 is a view showing as an example a double-torsion spring manufacturing procedure of the spring manufacturing apparatus according to the embodiment.
Figure 10:
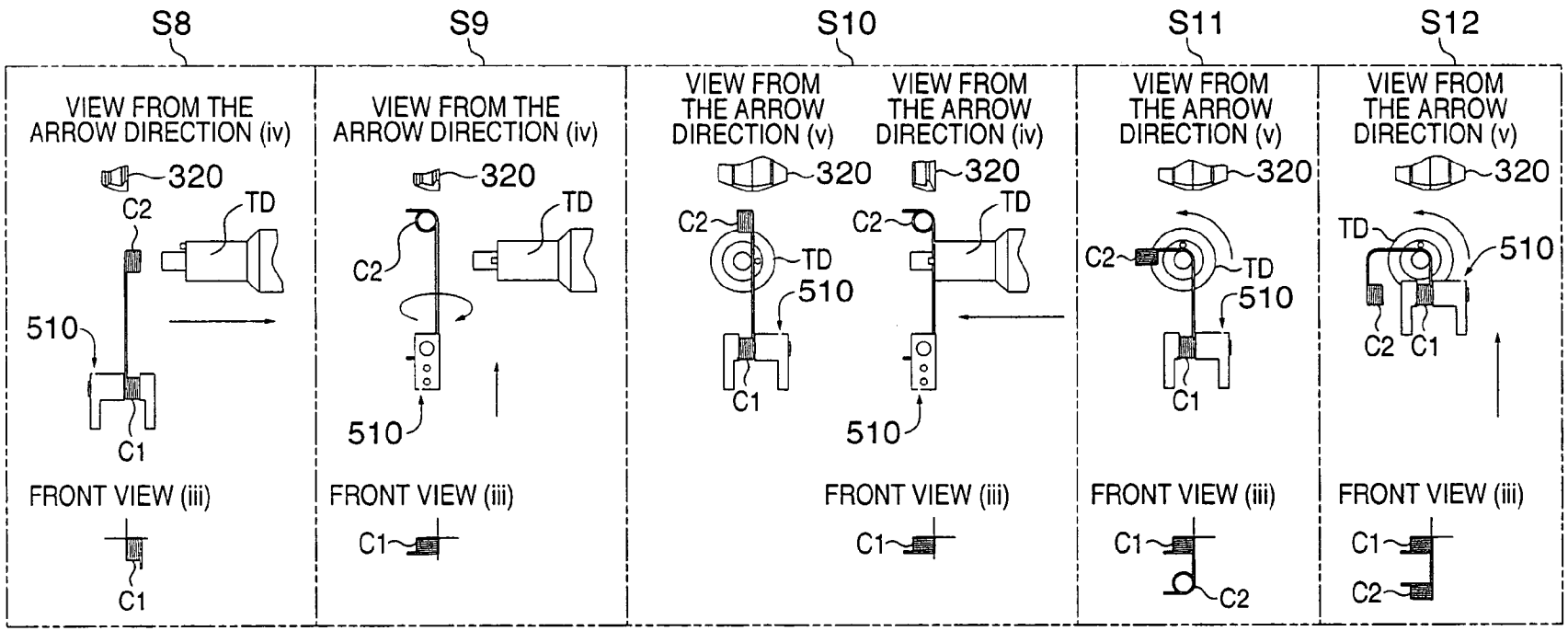
FIG. 10 is a view showing as an example a double-torsion spring manufacturing procedure of the spring manufacturing apparatus according to the embodiment.

Next described with reference to FIGS. 4, 9 and 10 is a spring manufacturing procedure of the spring manufacturing apparatus according to the present embodiment.

FIGS. 9 and 10 show as an example a double-torsion spring manufacturing procedure of the spring manufacturing apparatus according to the embodiment. Note that each of the components in FIGS. 9 and 10 is shown in accordance with the spring forming space seen from the direction of the arrow indicated in FIG. 4.

Each of the following steps is carried out by executing a program stored in the ROM 612 by the CPU 611 of the controller 601.

S1 (primary forming): While the wire is sequentially fed out of the wire feeder 300, the wire is pressed against the slide tool TA and wire guide 320, thereby forcibly being coiled to form the coil portion.

S2 and S3 (gripping): The air chuck 510 is moved forward to be adjacent to the end portion of the wire guide 320, and the first coil portion C1 is gripped by the fingers 511*a* and 511*b*.

S4 (wire feeding): While the first coil portion C1 is gripped by the fingers 511*a* and 511*b*, the air chuck 510 is moved backward to feed out the wire for secondary forming by a predetermined length. In this stage, it is controlled so that the air chuck's backward moving speed is synchronized with the wire's feeding speed.

S5 (cutting): While the first coil portion C1 is gripped by the fingers 511*a* and 511*b*, the wire guide 320 is rotated by a predetermined angle and the cutting tool TC is slid to cut the wire in cooperation with the wire guide 320.

S6 and S7 (secondary forming (winding)): While the first coil portion C1 is gripped by the fingers 511*a* and 511*b*, the wire guide 320 is rotated by a predetermined angle and the rotational tool TD is slid to secure the end portion of the cut wire. Thereafter, the air chuck 510 is moved forward and the rotational tool TD is rotated to wind the wire, which has been pulled in step S4, on the tool axis, thereby forming the second coil portion C2. In this stage, it is controlled so that the air chuck's forward moving speed is synchronized with the wire's winding speed which is determined by rotation of the rotational tool TD.

S8 and S9 (secondary forming (wire rotation)): While the first coil portion C1 is gripped by the fingers 511*a* and 511*b*, the rotational tool TD is moved back from the second coil portion C2, and the air chuck 510 is rotated by 90° to the right.

S10 to S12 (secondary forming (wire bending)): While the first coil portion C1 is gripped by the fingers 511*a* and 511*b*, the rotational tool TD is again slid to secure the wire between the first and second coil portions C1 and C2 (S10). Next, the rotational tool TD is rotated by 90°, thereby perpendicularly bending the wire of the second coil portion C2 (S11). Thereafter, the rotational tool TD is reversely rotated by 90° to return to the secure position in step S10, the air chuck 510 is moved forward by a predetermined distance, and the rotational tool TD is again rotated by 90°, thereby perpendicularly bending the wire of the first coil portion C1 to form a final shape. As a result, a double-torsion spring, having the first and second coil portions C1 and C2 face to face with each other at both ends is completed.

[Conventional Spring Manufacturing Method (FIGS. 11 and 12)]

A spring manufacturing procedure of a conventional spring manufacturing apparatus is described with reference to FIGS. 11 and 12.

Figure 11:
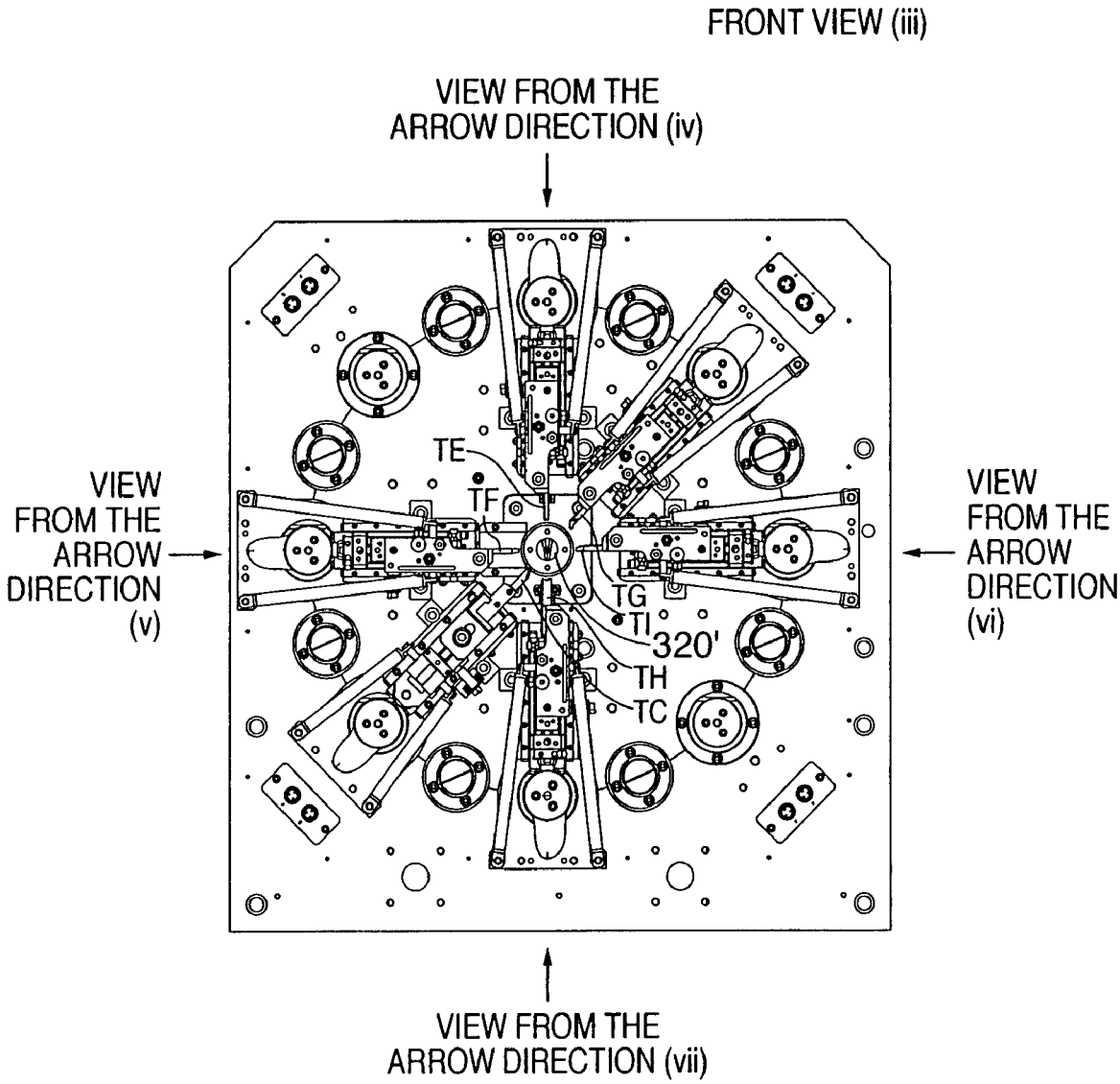
FIG. 11 is a front view of a conventional spring manufacturing apparatus.
Figure 12:
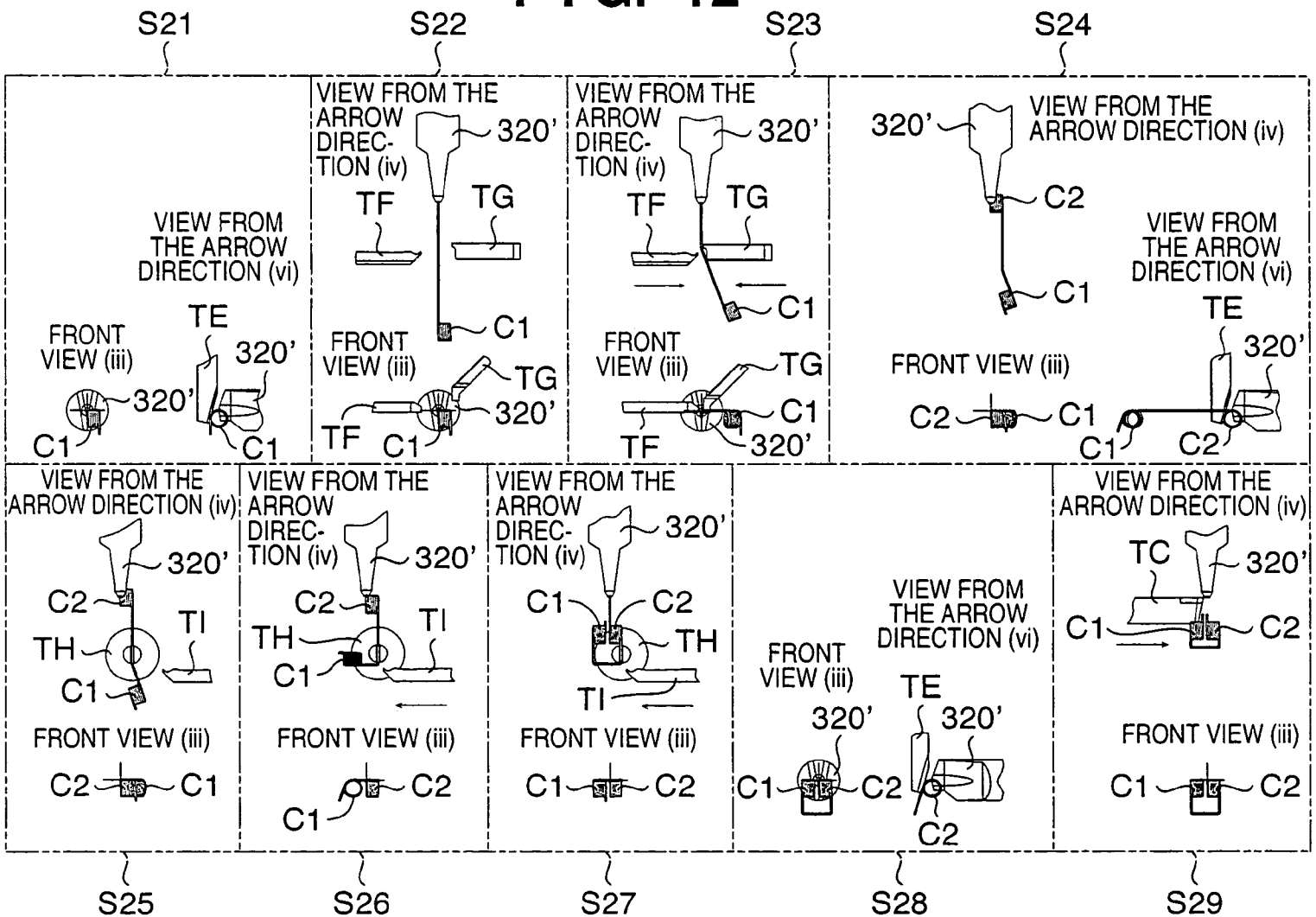
FIG. 12 is a view showing as an example a double-torsion spring manufacturing procedure of the conventional spring manufacturing apparatus.

FIG. 11 is a front view of a conventional spring manufacturing apparatus, and FIG. 12 is a view showing as an example a double-torsion spring manufacturing procedure of the conventional spring manufacturing apparatus. Note that each of the components in FIG. 12 is shown in accordance with the spring forming space seen from the direction of the arrow indicated in FIG. 11.

S21 (primary forming (coiling)): While the wire is sequentially fed, the wire is pressed against the slide tool TE and wire guide 320', thereby forcibly being coiled to form the first coil portion C1.

S22 and S23 (preliminary bending): The wire is fed out by a predetermined length, thereafter the bending tools TF and TG on both sides of the wire are moved forward to bend the vicinity of the central portion of the wire by about 30°. This is to prevent the first coil portion C1 from interfering with the wire guide and tool in the next step.

S24 (secondary forming (coiling)): Similarly to S1, while sequentially feeding out the wire, the wire is pressed against the slide tool TE and wire guide 320', thereby forcibly being coiled to form the second coil portion C2.

S25 to S27 (secondary forming (bending)): While the groove portion of the tool TH secures the neighborhood of the preliminary bent portion of the wire, the wire of the first coil portion C1 is perpendicularly bent by the bending tool TI (S26). Thereafter, the wire is fed out by a predetermined length, then the wire of the second coil portion C2 is perpendicularly bent by the tool TI in a similar manner (S27).

S28 (secondary forming (coiling)): The second coil portion C2 is pressed against the slide tool TE and wire guide 320', thereby aligning the angle of the cut piece of the first and second coil portions C1 and C2.

S29 (cutting): The wire is cut by the cutting tool TC. As a result, a double-torsion spring, having the first and second coil portions C1 and C2 face to face with each other at both ends is completed.

According to the above-described embodiment, since the spring that has been formed primarily into a partially finished shape can be gripped by the air chuck, after the wire is cut, the unprocessed wire portion can be subjected to further processing (secondary forming) with the same apparatus, and can be formed into a final shape.

Conventionally, in a case where a double-torsion spring having a complicated shape or the like is formed, a large number of tools (5 types of tools TC, TE, TF, TG, TH and TI) had to be moved in a precise and complicated fashion (e.g., preliminary processing in S22 and S23) as described with reference to FIGS. 11 and 12. In comparison, according to the present embodiment, only a small number of tools (3 types of tools TA, TC and TD) need to be motioned as described with reference to FIGS. 9 and 10. Furthermore, this embodiment no longer requires a tool for exclusive use (e.g., TH) as it was conventionally necessary, and a spring of a complicated shape can easily be formed with a smaller number of tools than the conventional technique, thus realizing improved productivity.

Moreover, since the number of tools used is reduced, the number of servomotors for driving the tools is also reduced. Therefore, while improving the apparatus' processing capability, the apparatus' cost and production cost can be reduced.

The present invention is not limited to the above embodiments and various changes and modifications can be made within the spirit and scope of the present invention. Therefore, to apprise the public of the scope of the present invention, the following claims are made.

What is claimed is:

1. A control method of a spring manufacturing apparatus having: a wire feeder which feeds a wire; a wire guide which guides the wire fed out of the wire feeder to a spring forming space on a forming table; a tool unit, a plurality of which can be arranged radially around the spring forming space on the forming table, which supports a tool so that the tool can be slidable toward the spring forming space; and a grip unit having face-to-face fingers for gripping part of a yet-to-be-cut spring that has been formed into a partially finished shape in the spring forming space and which can be moved adjacent to an end portion of the wire guide, said method comprising:

a primary forming step of forming the wire fed out of an end portion of the wire guide into a first coil portion using said tool;

a gripping step of gripping the first coil portion using the fingers of the grip unit;

a cutting step of cutting the wire which extends from the first coil portion to the wire guide, while the wire is gripped by the fingers; and a secondary forming step of forming a yet-to-be formed wire part extending from the first coil portion, which is gripped by the fingers after being cut, into a second coil portion by winding the yet-to-be formed wire part on a rotational tool while it is controlled so that a moving speed of the fingers which are gripping the first coil portion is synchronized with the wire winding speed which is determined by rotation of the rotational tool.

* * * * *